US012487057B1

(12) United States Patent
Obteshka et al.

(10) Patent No.: US 12,487,057 B1
(45) Date of Patent: Dec. 2, 2025

(54) MOUNTING RAIL ASSEMBLY FOR A CROSSBOW

(71) Applicant: Ravin Crossbows, LLC, Superior, WI (US)

(72) Inventors: Nicholas C. Obteshka, Springfield, OR (US); Kevin Casey, Rochester, NY (US)

(73) Assignee: Ravin Crossbows, LLC, Superior, WI (US)

( * ) Notice: Subject to any disclaimer, the term of this patent is extended or adjusted under 35 U.S.C. 154(b) by 165 days.

(21) Appl. No.: 18/393,119

(22) Filed: Dec. 21, 2023

Related U.S. Application Data

(60) Provisional application No. 63/434,774, filed on Dec. 22, 2022.

(51) Int. Cl.
*F41B 5/12* (2006.01)
*F41B 5/14* (2006.01)
*F41G 11/00* (2006.01)

(52) U.S. Cl.
CPC ..... *F41G 11/003* (2013.01); *F41B 5/12* (2013.01); *F41B 5/123* (2013.01); *F41B 5/148* (2013.01)

(58) Field of Classification Search
CPC ..... F41B 5/12; F41B 5/123
See application file for complete search history.

(56) References Cited

U.S. PATENT DOCUMENTS

| | | | | |
|---|---|---|---|---|
| 9,212,862 | B2 * | 12/2015 | Biafore, Jr. | F41B 5/12 |
| 9,291,421 | B1 * | 3/2016 | Kempf | F41B 5/12 |
| 9,599,426 | B2 * | 3/2017 | Darlington | F41B 5/12 |
| 10,690,435 | B2 * | 6/2020 | Trpkovski | F41B 5/10 |
| 11,536,533 | B2 * | 12/2022 | McPherson | F41B 5/123 |
| 11,796,277 | B2 | 10/2023 | Mcpherson | |
| 12,000,668 | B2 | 6/2024 | Mcpherson | |
| 12,000,669 | B2 | 6/2024 | Mcpherson et al. | |
| 2022/0397369 | A1 * | 12/2022 | Smith | F41B 5/143 |

* cited by examiner

*Primary Examiner* — John A Ricci
(74) *Attorney, Agent, or Firm* — FOLEY & LARDNER LLP

(57) ABSTRACT

A crossbow includes a stock, a riser, a barrel rail coupled between the stock and the riser and defining a projectile axis, a limb assembly coupled to the riser, and a mounting rail assembly. The mounting rail assembly includes a mounting rail defining a first axial end and a second axial end, a first mounting bar coupled to the barrel rail and the first axial end of the mounting rail, and a second mounting bar coupled to the barrel rail and the second axial end of the mounting rail.

20 Claims, 10 Drawing Sheets

MOUNTING RAIL ASSEMBLY FOR A CROSSBOW

CROSS-REFERENCE TO RELATED PATENT APPLICATION

This application claims the benefit of and priority to U.S. Provisional Application No. 63/434,774, entitled "Mounting Rail Assembly for a Crossbow," filed on Dec. 22, 2022, the entire disclosure of which is hereby incorporated by reference herein.

BACKGROUND

Crossbows typically utilize a drawstring that is drawn back and released to fire a projectile (e.g., an arrow). The drawstring is coupled to a limb assembly that includes one or more flexible limbs that are loaded in response to the drawstring being drawn back. Upon the drawstring being released, the flexible limbs unload and fire the projectile toward a target.

SUMMARY

One embodiment relates to a crossbow. The crossbow includes a stock, a riser, a barrel rail coupled to the stock and the riser and that defines a projectile axis, a limb assembly coupled to the riser, and a mounting rail assembly. The mounting rail assembly includes a mounting rail, a first mounting bar, and a second mounting bar. The mounting rail defines a first axial end and a second axial end. The first mounting bar is coupled between the barrel rail and the first axial end of the mounting rail. The second mounting bar coupled between the barrel rail and the second axial end of the mounting rail.

Another embodiment relates to a mounting rail assembly for a crossbow. The mounting rail assembly includes a mounting rail, a first mounting bar, and a second mounting bar. The mounting rail includes a first axial end and a second axial end. The first mounting bar is detachably coupled to the first axial end of the mounting rail. The first mounting bar includes a first pair of leg portions having at least one notch arranged in a forward-facing orientation. The first pair of leg portions extends from the mounting rail. The second mounting bar is detachably coupled to the second axial end of the mounting rail. The second mounting bar includes a second pair of leg portions having at least one notch arranged in a rearward-facing orientation. The second pair of leg portions extends from the mounting rail.

Still another embodiment relates to a crossbow. The crossbow includes a stock, a riser, a barrel rail coupled to the stock and the riser that defines a projectile axis, a first cam and a second cam, a drawstring, and a mounting rail assembly. The drawstring engages with the first cam and the second cam. The drawstring extends across the projectile axis and is configured to move from an undrawn position and a drawn position during operation of the crossbow. The mounting rail assembly includes a mounting rail defining a first axial end and a second axial end, a first mounting bar, and a second mounting bar. The first mounting bar is coupled to the barrel rail and the first axial end of the mounting rail. The second mounting bar coupled to the barrel rail and the second axial end of the mounting rail. The drawstring extends across the projectile axis at an axial position between the first mounting bar and the second mounting bar.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

DETAILED DESCRIPTION

Figure 1:
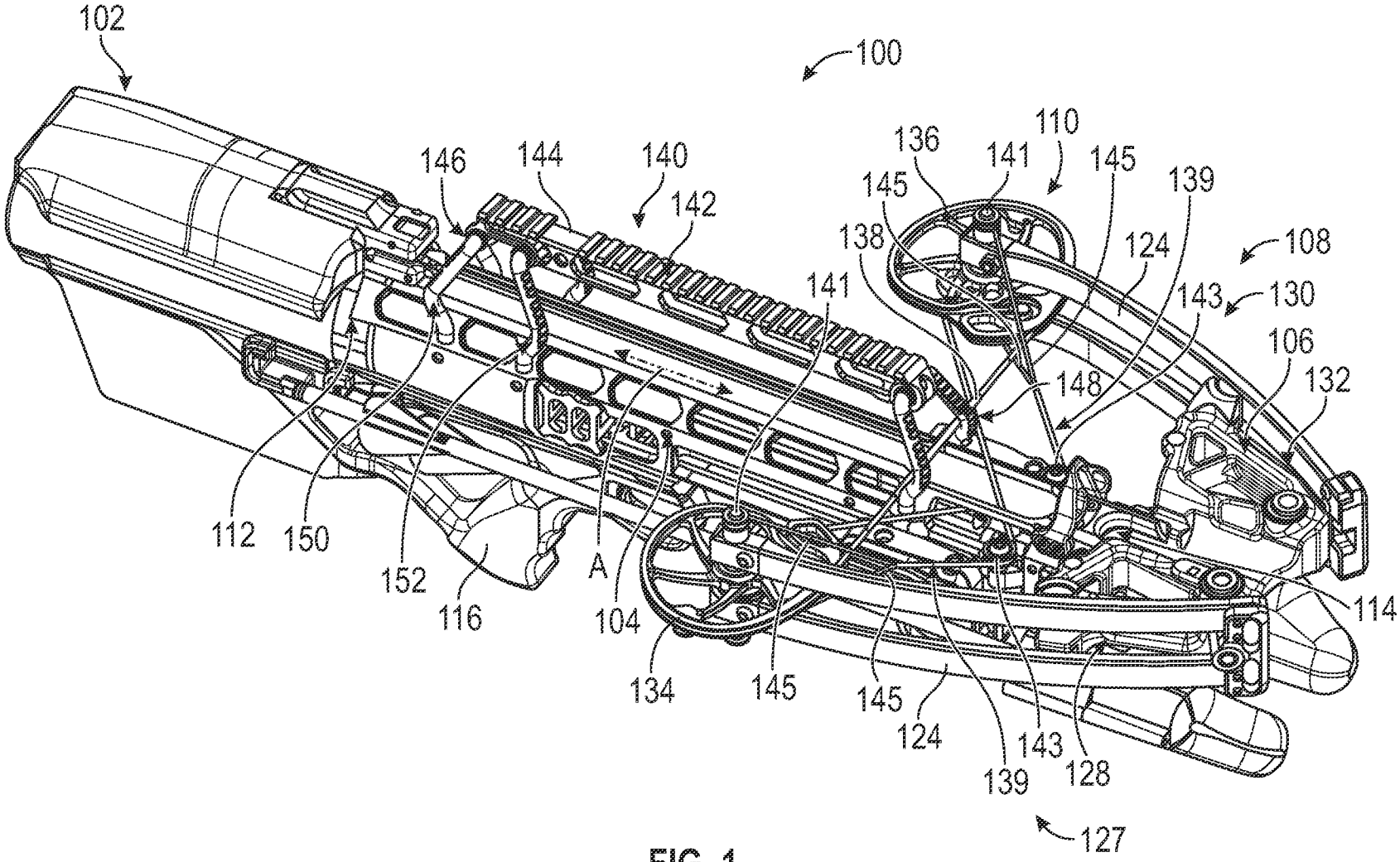
FIG. 1 is a top, front, right perspective view of a crossbow, according to an exemplary embodiment.

Following below are more detailed descriptions of various concepts related to, and implementations of, methods, apparatuses, and systems for a mounting rail assembly on a crossbow. Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

The use herein of the term "axial" and variations thereof refers to a direction that extends generally along an axis of symmetry, a central axis, or an elongate direction of a particular component or system. For example, axially extending features of a component may be features that extend generally along a direction that is parallel to an axis of symmetry or an elongate direction of that component. Similarly, the use herein of the term "radial" and variations thereof refers to directions that are generally perpendicular to a corresponding axial direction. For example, a radially extending structure of a component may generally extend at least partly along a direction that is perpendicular to a longitudinal or central axis of that component. The use herein of the term "circumferential" and variations thereof refers to a direction that extends generally around a circumference of an object or around an axis of symmetry, a central axis, or an elongate direction of a particular component or system.

Referring to the figures generally, the various embodiments disclosed herein relate to systems, apparatuses, and methods for a mounting rail assembly on a crossbow. In general, the mounting rail assembly described herein includes a mounting rail and mounting components that facilitate coupling the mounting rail to a crossbow. In some embodiments, the mounting components include two or more mounting bars that are coupled to a barrel rail on the crossbow. The mounting bars are designed to couple the mounting rail to the barrel rail so that the mounting rail is elevated above the barrel rail (e.g., above a flight groove or arrow track on the barrel rail) to provide sufficient clearance for a drawstring on the crossbow to move between an undrawn position and a drawn position (i.e., the mounting bars, and general installation of the mounting rail assembly on the crossbow, do not interfere with the firing operation of the crossbow).

In some embodiments, each of the mounting bars defines a generally U-shaped profile and includes a first mounting post, a second mounting post, and a crossbar portion arranged laterally between the first mounting post and the second mounting post. In some embodiments, the barrel rail includes two or more groups of mounting apertures that facilitate coupling the mounting bars to the barrel rail. For example, each group of mounting apertures may be axially spaced from an adjacent group of mounting apertures and each group of mounting apertures may include a pair of axially-aligned mounting apertures that are laterally spaced from one another. A respective one of the mounting bars is configured to be installed within each group mounting apertures, with the first mounting post being inserted within one of the mounting apertures and the second mounting post being inserted within the other mounting aperture. In some embodiments, each of the mounting bars is secured to the barrel rail by a fastener or set screw (e.g., each of the first mounting posts and the second mounting posts is in engagement with a set screw). The set screws may be selectively tightened to secure the mounting bars to the barrel rail and selectively loosened to enable removal of the mounting bars (and the mounting rail) from the barrel rail.

In some embodiments, the mounting rail is coupled to the crossbar portion on each of the mounting bars. For example, the mounting rail may include two or more slot openings, each of which is configured to receive a respective one of the crossbar portions to couple the mounting rail to the mounting bars. In some embodiments, the slot openings are coupled to the crossbar portions by a press fit or an interference fit. For example, a size of the crossbar portions on the mounting bars may be greater than or equal to a size defined by the slot openings so that with the slot openings of the mounting rail inserted onto the crossbar portions of the mounting bars, the interference (e.g., engagement) between the crossbar portions and the slot openings secures the mounting rail to the mounting bars. In some embodiments, each of the mounting bars is overmolded with an elastic or semi-flexible material (e.g., plastic, resin, polymer, rubber, etc.) that at least partially deforms as the mounting rail is inserted onto the crossbar portions of the mounting bars, which forms a strong interference or press fit between the mounting bars and the mounting rail.

In some embodiments, the mounting rail is a Picatinny rail that facilitates attachment of one or more accessories to the crossbow (e.g., sights, scopes, optics, scent bottles, etc.). In some embodiments, the mounting rail includes a first slot opening and a second slot opening that is axially separated from the first slot opening. For example, the first slot opening may be arranged adjacent to a first end of the mounting rail and the second slot opening may be arranged adjacent to an opposing second end of the mounting rail. Arranging the first slot opening and the second slot opening at opposite ends of the mounting rail provides structural support at both ends of the mounting rail via coupling to a respective one of the mounting bars. With the mounting rail supported at both ends, the movement and flexing of the mounting rail is reduced or eliminated when compared to conventional cantilevered mounting rails, which can undesirably move or flex during operation and require recalibration of sights/optics coupled to the mounting rail.

Figure 2:
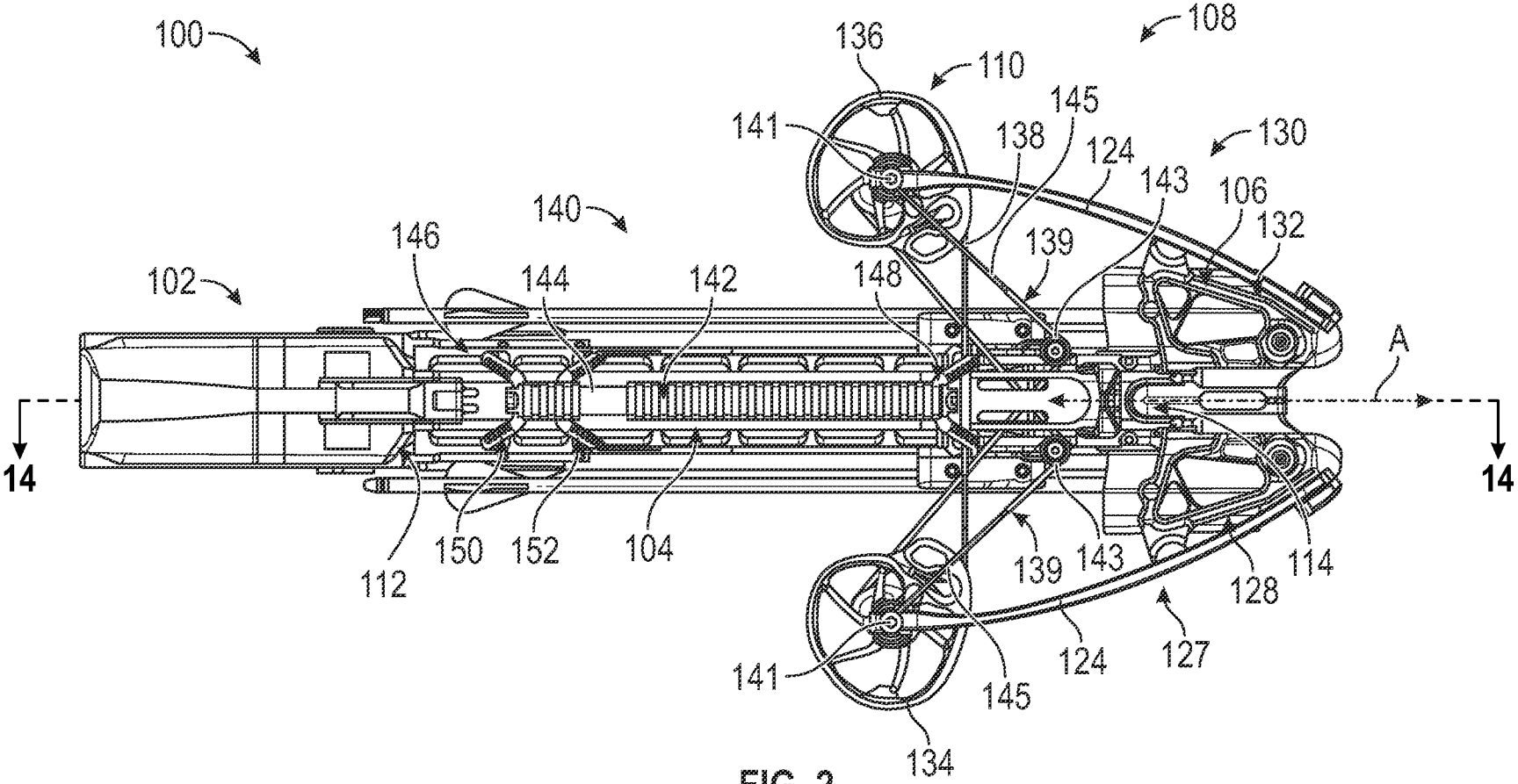
FIG. 2 is a top view of the crossbow of FIG. 1.
Figure 3:
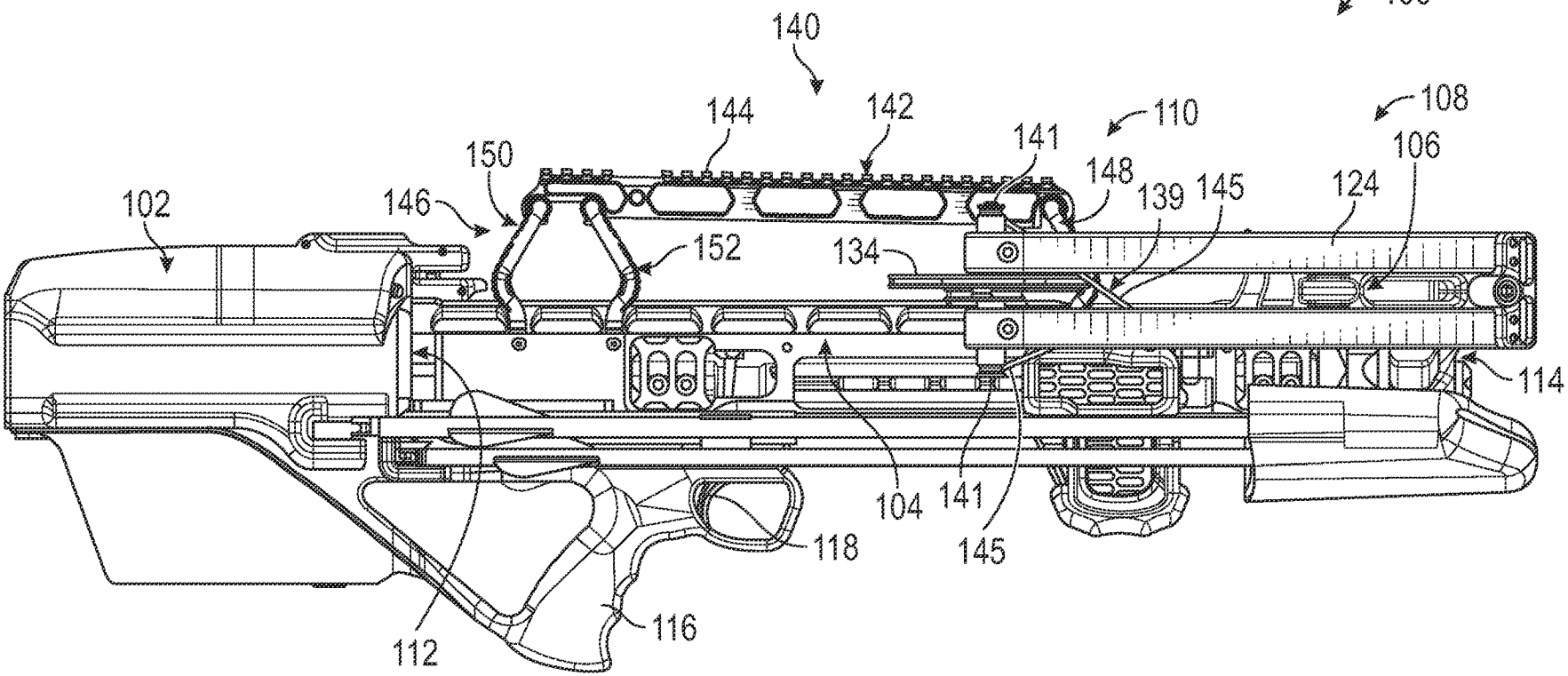
FIG. 3 is a right side view of the crossbow of FIG. 1.

FIGS. 1-3 show a crossbow 100 according to an exemplary embodiment. The crossbow 100 includes a stock 102, a barrel rail 104, a riser 106, a limb assembly 108, and a cam assembly 110. The barrel rail 104 is coupled between the stock 102 and the riser 106, with the stock 102 being arranged at a first or rear end 112 of the barrel rail 104 and the riser 106 being arranged at a second or front end 114 of the barrel rail 104. The stock 102 includes a grip 116 and a trigger 118 (see FIG. 3). During operation, a user may grasp the grip 116 and manipulate the trigger 118 (e.g., compress the trigger 118) to fire a projectile from the crossbow 100.

The barrel rail 104 defines a projectile axis A (see FIG. 2) along which a projectile can be arranged and fired. In some embodiments, an upper surface 120 of the barrel rail 104 defines a flight groove or arrow track 122 that extends axially along the projectile axis A (see, e.g., FIG. 4). The riser 106 is coupled to the limb assembly 108 so that the limb assembly 108 can flex relative to the riser 106. For example, the limb assembly 108 includes a plurality of flexible limbs 124 that each extend from the riser 106, in a direction back toward the rear end 112, to a free end. The free ends of the flexible limbs 124 enable the flexible limbs 124 to flex relative to the riser 106 and generate a firing force that is applied to a projectile as the crossbow 100 is fired. In some embodiments, the limb assembly 108 includes a first limb assembly 127 coupled to a first lateral side 128 (e.g., a right side) of the riser 106 and a second limb assembly 130 coupled to a second lateral side 132 (e.g., a left side) of the riser 106. In the illustrated embodiment, the first limb assembly 127 and the second limb assembly 130 both include two flexible limbs 124. In some embodiments, the first limb assembly 127 and the second limb assembly 130 both include more or less than two flexible limbs 124 (e.g., one flexible limb 124, three flexible limbs 124, etc.).

The cam assembly 110 includes a first cam 134 (e.g., a right cam) and a second cam 136 (e.g., a left cam). The first cam 134 is rotatably coupled to the free ends of the flexible limbs 124 in the first limb assembly 127, and the second cam 136 is rotatably coupled to the free ends of the flexible limbs 124 in the second limb assembly 130. The cam assembly 110 is coupled to a drawstring 138 that is configured to move between an undrawn position (see, e.g., FIG. 1) and a drawn position where the drawstring 138 is displaced along the projectile axis A toward the stock 102 (i.e., toward the rear end 112 of the barrel rail 104). The cam assembly 110 is further coupled to one or more power cables 139. A first power cable is 139 engages with the first cam 134. A second power cable 139 engages with the second cam 136.

More particularly, the first power cable 139 engages with a power cable groove, journal, pulley, or other portion of the first cam 134. The first power cable 139 is routed from the first cam 134 to a first pulley 143 (e.g., an idler), and from the first pulley 143 toward the second limb assembly 130. The first pulley 143 is rotatably coupled to the barrel frame 104 or the riser 106. The first power cable 139 includes upper and lower portions 145 (e.g., upper and lower portions of the same cable 139) that are respectively coupled to a top and bottom region 141 of an axle about which the second cam 136 rotates. In other embodiments, the upper and lower portions 145 are coupled to one or more flexible limbs 124 to which the second cam 136 is coupled. Because the first power cable 139 is routed from the first cam 134 to the second cam 136, the first power cable 139 crosses over the projectile axis A. The second power cable 139 engages with a power cable groove, journal, pulley, or other portion of the second cam 136. The second power cable 139 is routed from the second cam 136 to a second pulley 143 (e.g., an idler), and from the second pulley 143 toward the first limb assembly 127. The pulley 143 is rotatably coupled to the barrel frame 104 or the riser 106. The second pulley 143 is rotatably coupled to the barrel frame 104 or the riser 106. The second power cable 139 includes upper and lower portions 145 (e.g., upper and lower portions of the same cable 139) that are respectively coupled to a top and bottom region 141 of an axle about which the first cam 134 rotates. In other embodiments, the upper and lower portions 145 are coupled to one or more flexible limbs 124 to which the first cam 134 is coupled. Because the second power cable 139 is routed from the second cam 136 to the first cam 134, the second power cable 139 crosses over the projectile axis A.

As the drawstring 138 is displaced from the undrawn position to the drawn position, the first cam 134 and the second cam 136 rotate relative to the free ends of the flexible limbs 124, and the flexible limbs 124 flex relative to the riser 106. As the first cam 134 and the second cam 136 rotate, the first power cable 139 and the second power cable 139 are respectively wound on the first cam 134 and the second cam 136 (e.g., via the power cable journal or similar feature). The flexing of the flexible limbs 124 loads the flexible limbs 124 and generates a firing force on the drawstring 138. Once the drawstring 138 is in the drawn position, a user may selectively compress the trigger 118 to release the drawstring 138 and unload the flexible limbs 124. The drawstring 138 then travels back to the undrawn position and the unloading of the flexible limbs 124 transfers the firing force to a projectile notched to the drawstring 138, and fires the projectile along the projectile axis A and outwardly from the front end 114 of the barrel rail 104.

In the illustrated embodiment, the crossbow 100 includes a mounting rail assembly 140 that is removably coupled to the barrel rail 104. In general, the mounting rail assembly 140 includes a mounting rail 142 that includes a mounting platform 144. The mounting platform 144 defines a platform on which one or more accessories may be coupled to the crossbow 100 (e.g., sights, scopes, optics etc.). The mounting platform 144 of the mounting rail 142 may define a shape and/or pattern that conforms to a standard mounting interface. For example, in the illustrated embodiment, the mounting rail 142 is a Picatinny rail and the mounting platform 144 includes alternating protrusion and grooves that conform to the standardized shape and dimensions for a Picatinny rail. In some embodiments, the mounting rail 142 and the corresponding mounting platform 144 define an alternative mounting interface (e.g., a Weaver rail). In some embodiments, the mounting platform 144 is divided into multiple segments or portions, with each segment or portion separated by a space (e.g., a gap, a recess, a void) between the segments or portions of the mounting platform 144. In other embodiments, the mounting platform 144 is substantially continuous along a length of the mounting rail 142. Regardless of the specific mounting interface defined by the mounting rail 142, the mounting rail assembly 140 includes two or more mounting bars 146 that are configured to couple the mounting rail 142 to the barrel rail 104.

Figure 4:
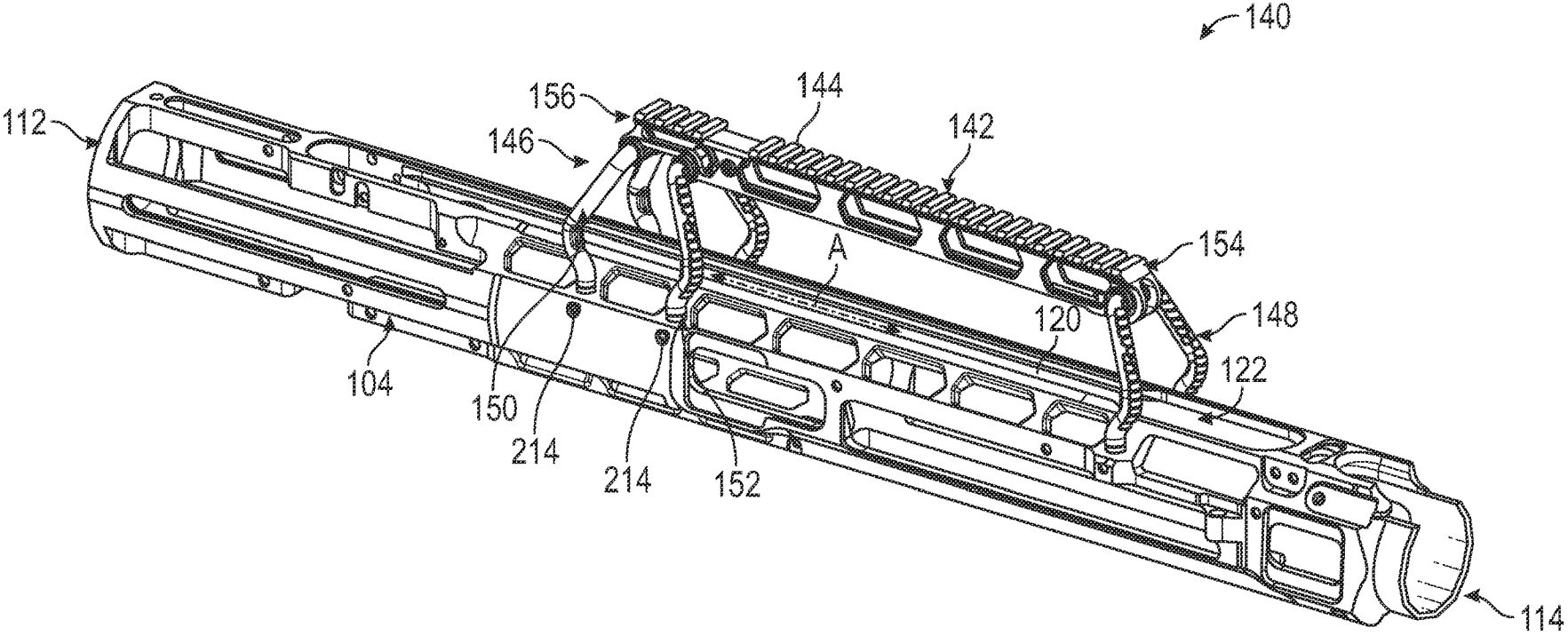
FIG. 4 is atop, front, right perspective view of amounting rail assembly of the crossbow of FIG. 1 mounted on a barrel rail of the crossbow.
Figure 5:
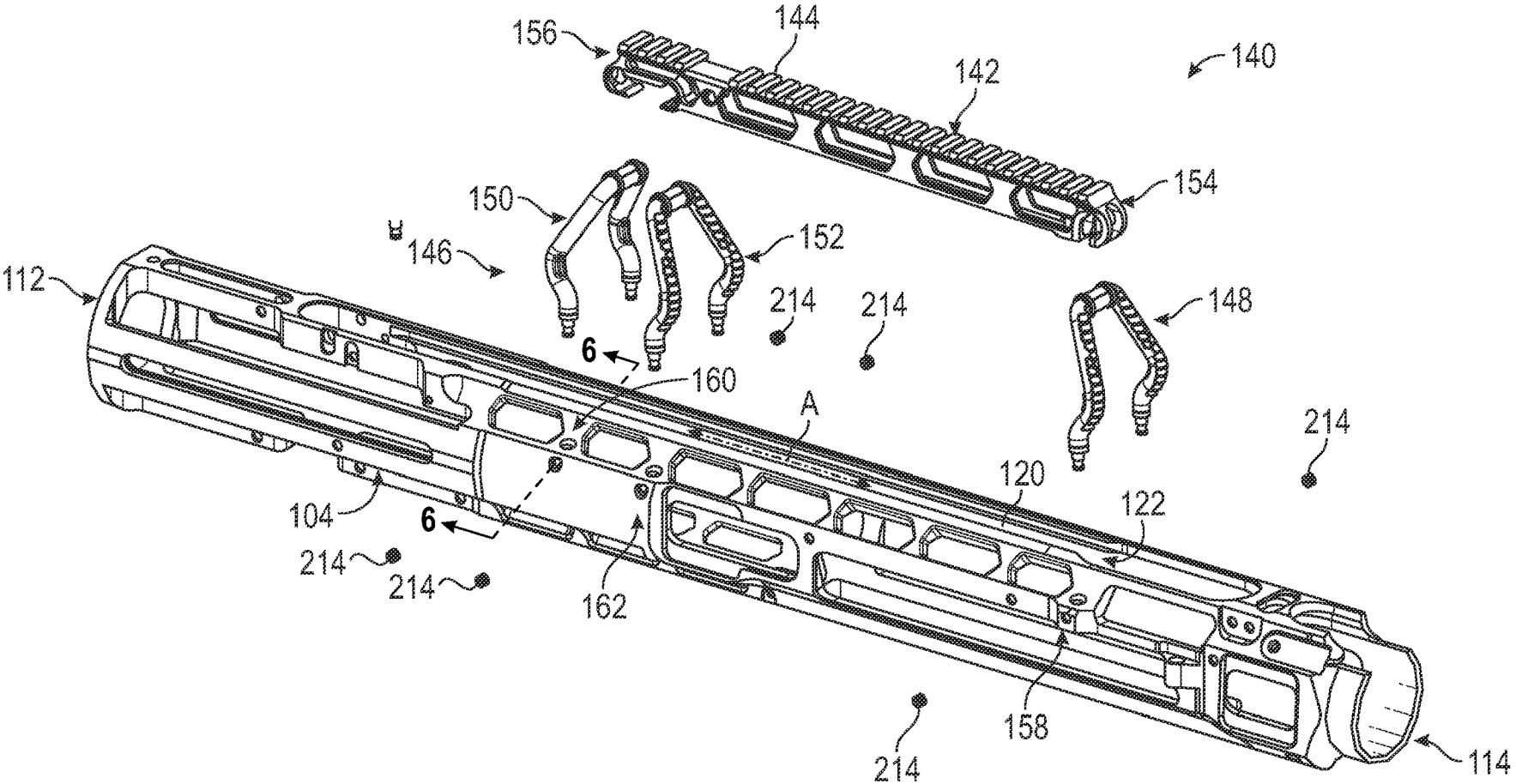
FIG. 5 is an exploded view of the mounting rail assembly of FIG. 4.
Figure 7:
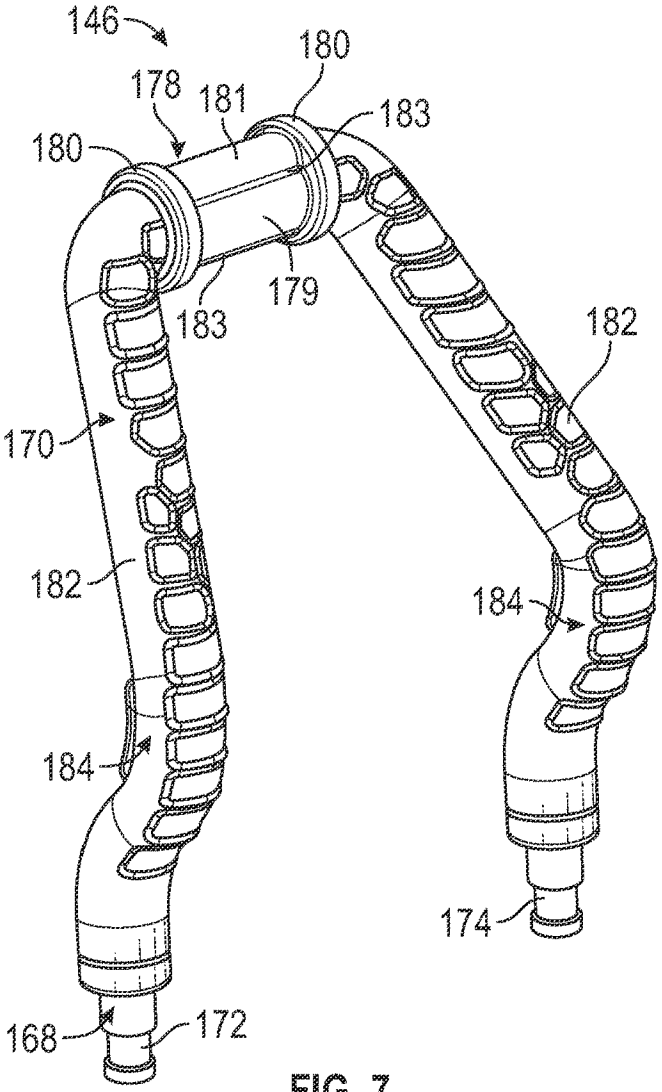
FIG. 7 is a top, front, right perspective view of a mounting bar of the mounting rail assembly of FIG. 4.
Figure 6:
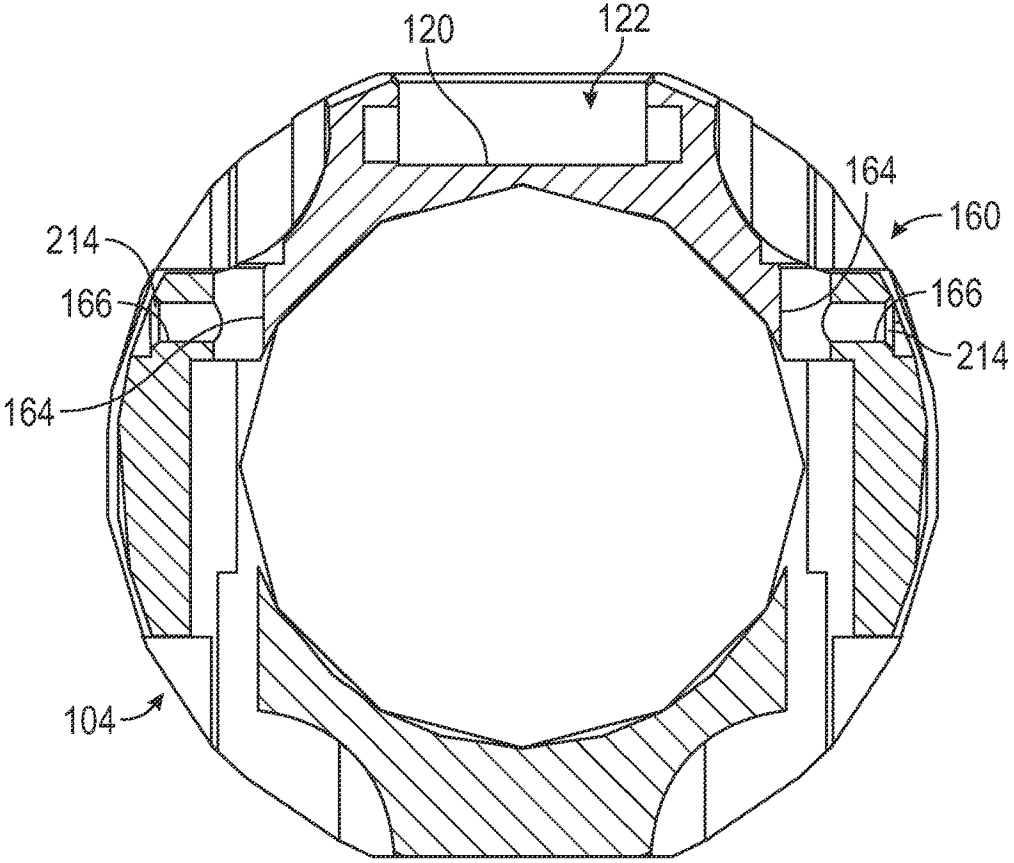
FIG. 6 is a cross-sectional view of a barrel rail of FIG. 4 taken along line 6-6 of FIG. 5.
Figure 9:
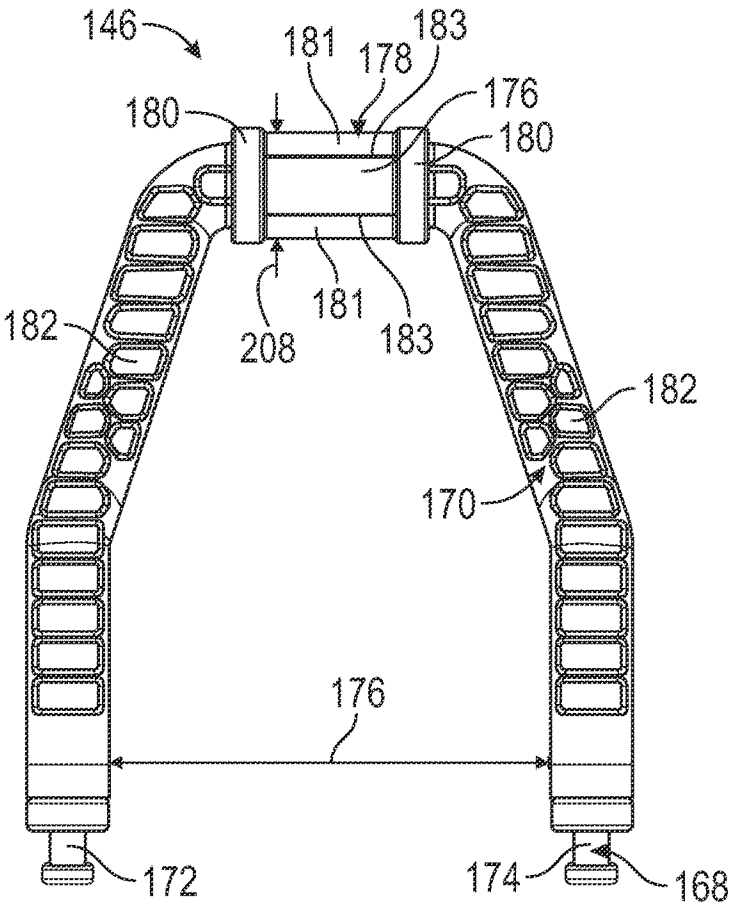
FIG. 9 is a front view of the mounting bar of FIG. 7.

As shown in FIGS. 4-6, the mounting rail assembly 140 includes three mounting bars 146 each being coupled between the mounting rail 142 and the barrel rail 104. In some embodiments, the mounting rail assembly 140 includes more or less than three mounting bars 146 (e.g., two mounting bars 146, four mounting bars 146, etc.). The mounting bars 146 are axially separated and spaced from one another along the projectile axis A and the barrel rail 104. For example, the mounting bars 146 can include a first mounting bar 148, a second mounting bar 150, and a third mounting bar 152. The first mounting bar 148 is coupled to a first or front axial end 154 of the mounting rail 142, the second mounting bar 150 is coupled to a second or rear axial end 156 of the mounting rail 142, and the third mounting bar 152 is coupled to the mounting rail 142 at a location between the first end 154 and the second end 156 (i.e., the third mounting bar 152 is arranged axially between the first mounting bar 148 and the second mounting bar 150). In some embodiment, the mounting rail assembly 140 only includes the first mounting bar 148 and the second mounting bar 150. In some embodiments, the mounting rail assembly 140 includes a fourth mounting bar arranged axially between the first mounting bar 148 and the third mounting bar 152.

In general, the barrel rail 104 includes two or more groups of mounting apertures that facilitate coupling the mounting bars 146 to the barrel rail 104. For example, the barrel rail 104 may include a first group of mounting apertures 158, a second group of mounting apertures 160, and a third group of mounting apertures 162 (see, e.g., FIGS. 5 and 6). The first group of mounting apertures 158 is arranged adjacent to the front end 114 of the barrel rail 104, the second group of mounting apertures 160 is axially spaced from the first group of mounting apertures 158 in a direction toward the rear end 112 of the barrel rail 104, and the third group of mounting apertures 162 is arranged axially between the first group of mounting apertures 158 and the second group of mounting apertures 160. The first group of mounting apertures 158, the second group of mounting apertures 160, and the third group of mounting apertures 162 are configured to receive at least a portion of the first mounting bar 148, the second mounting bar 150, and the third mounting bar 152, respectively.

With specific reference to FIG. 6, the second group of mounting apertures 160 includes a pair of mounting apertures 164 that extend through the barrel rail 104 in a first direction (e.g., a vertical direction from the perspective of FIG. 6) and a pair of set screw apertures 166 that extend through the barrel rail 104 in a second direction (e.g., a horizontal direction from the perspective of FIG. 6). The pair of mounting apertures 164 are axially aligned and laterally separated (e.g., arranged on laterally opposing sides of the flight groove 122). In some embodiments, the set screw apertures 166 are arranged approximately perpendicular to the mounting apertures 164. Each of the set screw apertures 166 extends laterally inward into the barrel rail 104 and connects to a respective one of the mounting apertures 164. Although only the second group of mounting apertures 160 is shown in FIG. 6, the description herein of the second group of mounting apertures 160 also applies to the first group of mounting apertures 158 and the third group of mounting apertures 162. For example, each of the first group of mounting apertures 158 and the third group of mounting apertures 162 includes a pair of mounting apertures 164 and a pair of set screw apertures 166 in the orientations described with respect to the second group of mounting apertures 160.

In general, each of the mounting bars 146 may define the same shape and structure. Accordingly, the following description of the mounting bar 146 illustrated in FIGS. 7-11 applies to each of the first mounting bar 148, the second mounting bar 150, and the third mounting bar 152. As shown in FIGS. 7-10, the mounting bar 146 defines a generally U-shaped profile and includes a core bar 168 and a sleeve 170 that is arranged over at least a portion of the core bar 168. In some embodiments, the core bar 168 is formed from a metal material (e.g., aluminum) that is bent into the shape illustrated in FIGS. 7-10. In some embodiments, the sleeve 170 is overmolded onto at least a portion of the core bar 168. In some embodiments, the sleeve 170 is formed from an elastic material (e.g., plastic, resin, polymer, rubber, etc.). In some embodiments, the sleeve 170 is formed from polyurethane.

In the illustrated embodiment, the sleeve 170 covers an entirety of the core bar 168, except for a first mounting post 172 and a second mounting post 174 where the core bar 168 extends outwardly from the sleeve 170. The first mounting post 172 is laterally separated from the second mounting post 174 to define a string clearance 176 between the first mounting post 172 and the second mounting post 174 (see, e.g., FIG. 9). A crossbar portion 178 is arranged laterally between the first mounting post 172 and the second mounting post 174 and extends in a direction that is generally perpendicular to the first mounting post 172 and the second mounting post 174 (e.g., horizontally from the perspective of FIG. 9). The crossbar portion 178 is arranged between a pair of mounting flanges 180 that extend radially outwardly to define a size or diameter that is greater than a size or diameter of the crossbar portion 178. In general, the mounting flanges 180 aid in aligning the mounting rail 142 over the crossbar portion 178 as will be described herein.

As depicted in FIGS. 7-9 and 14, among others, the crossbar portion 178 of the mounting bar 146 includes a body 179. The body 179 is a central region of the crossbar portion 178. As shown, the body 179 includes a generally circular profile or cross-sectional shape. In other embodiments, the body 179 includes some other profile (e.g., ovular, hexagonal, octagonal, or some other shape). The crossbar portion 178 includes at least one protrusion 181 (e.g., a raised portion, a ridge, a nub, a hump, a projection, or some other protrusion). The protrusion 181 extends from the body 179 of the crossbar portion 178. According to an exemplary embodiment, the crossbar portion 178 includes two protrusions 181. For example, a first protrusion 181 extends outwardly (e.g., radially) from a top the body 179 such that the first protrusion 181 defines an upper portion of the crossbar portion 178. A second protrusion 181 extends outwardly (e.g., radially) from a bottom of the body 179 such that the second protrusion 181 defines a lower portion of the crossbar portion 178. The first and second protrusions 181 include a generally rounded or semi-circular shape. In other embodiments, the first and second protrusions 181 include some other cross-sectional shape or profile (e.g., rectangular, triangular, or some other shape). In other embodiments, the crossbar portion 178 includes only one protrusion 181 or more than two protrusions 181. In yet other embodiments, the crossbar portion 178 includes one or more protrusions 181 extending from a side of the body 179 rather than a top or bottom. The crossbar portion 178 further includes at least one notch 183. The notch 183 is positioned between the body 179 and the protrusion 181. For example, the notch 183 can be a region of the crossbar portion 178 where the body 179 transitions into the protrusion 181. Because the protrusion 181 extends from the body 179, the notch 183 is a recessed area of the crossbar portion 178. The notch 183 can be a rounded notch, a V-shaped notch, or a notch having some other geometry.

The mounting bar 146 defines a pair of leg portions 182 extending from opposing ends of the crossbar portion 178. In general, the leg portions 182 are symmetric to one another and each define a rounded notch 184 formed between the crossbar portion 178 and a respective one of the first mounting post 172 and the second mounting post 174. In some embodiments, the first mounting post 172 and the second mounting post 174 define a plane P that extends parallel to and through a centerline of both the first mounting post 172 and the second mounting post 174. As each of the leg portions 182 extends from a respective one of the first mounting post 172 or the second mounting post 174 toward the crossbar portion 178, the leg portions 182 initially curve outwardly away from the plane P (e.g., to the right from the perspective of FIG. 10) and then curve back toward the plane P (e.g., to the left from the perspective of FIG. 10) to define the rounded notch 184. From the rounded notch 184, the leg portions 182 angle away from the rounded notch 184, intersect through the plane P, and end at a junction between the leg portions 182 and the crossbar portion 178. The curved shape defined by the leg portions 182 offsets the rounded notches 184 from the crossbar portion 178. For example, the rounded notches 184 are positioned on a first side of the plane P (e.g., a right side from the perspective of FIG. 10) and the crossbar portion 178 is positioned on a second side of the plane P (e.g., a left side from the perspective of FIG. 10).

Figure 8:
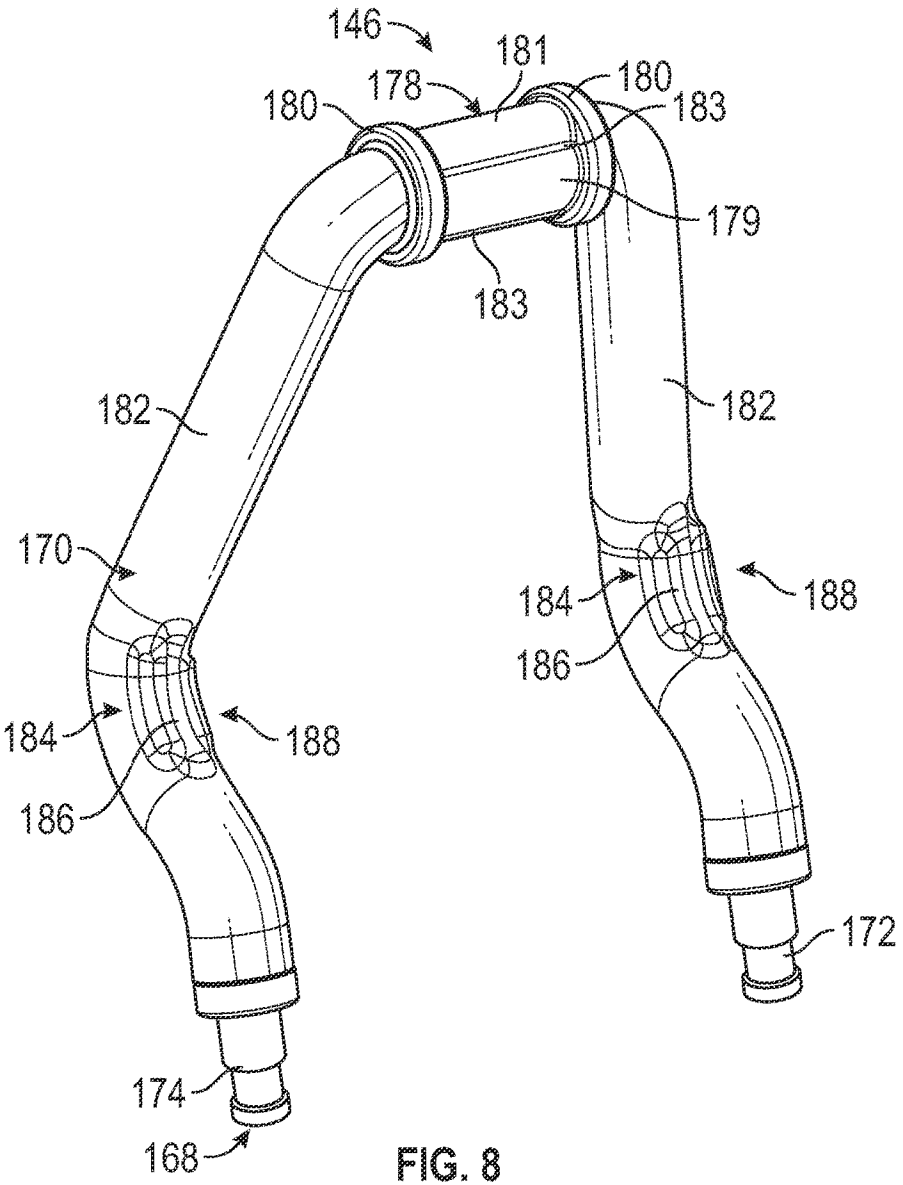
FIG. 8 is a bottom, rear, left perspective view of the mounting bar of FIG. 7.
Figure 11:
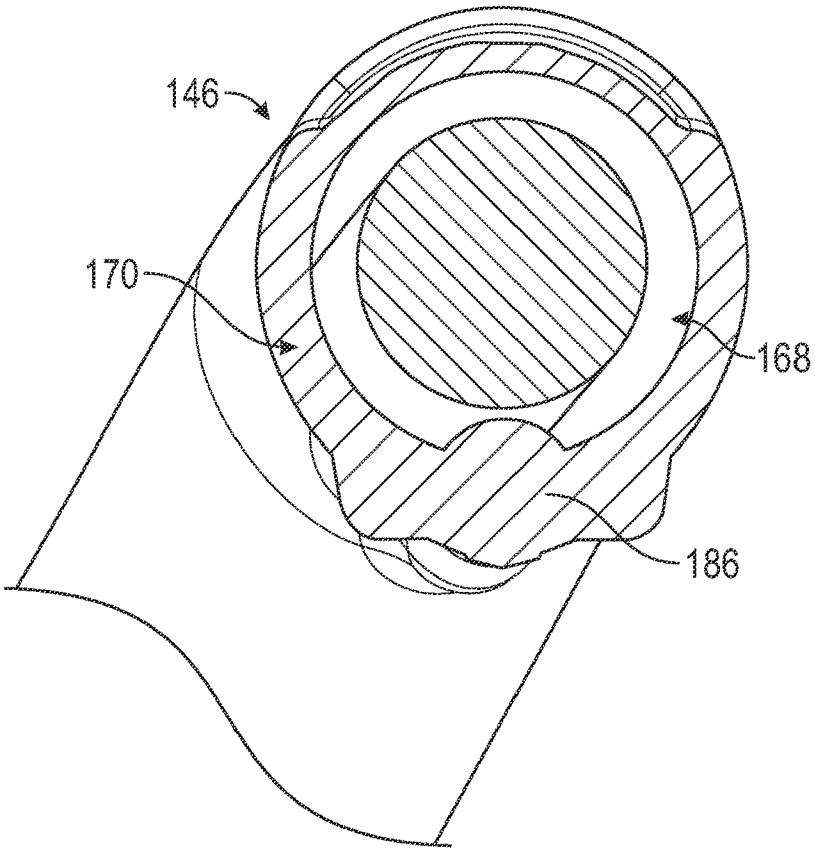
FIG. 11 is a cross-sectional view of the mounting bar of FIG. 10 taken along line 11-11.
Figure 10:
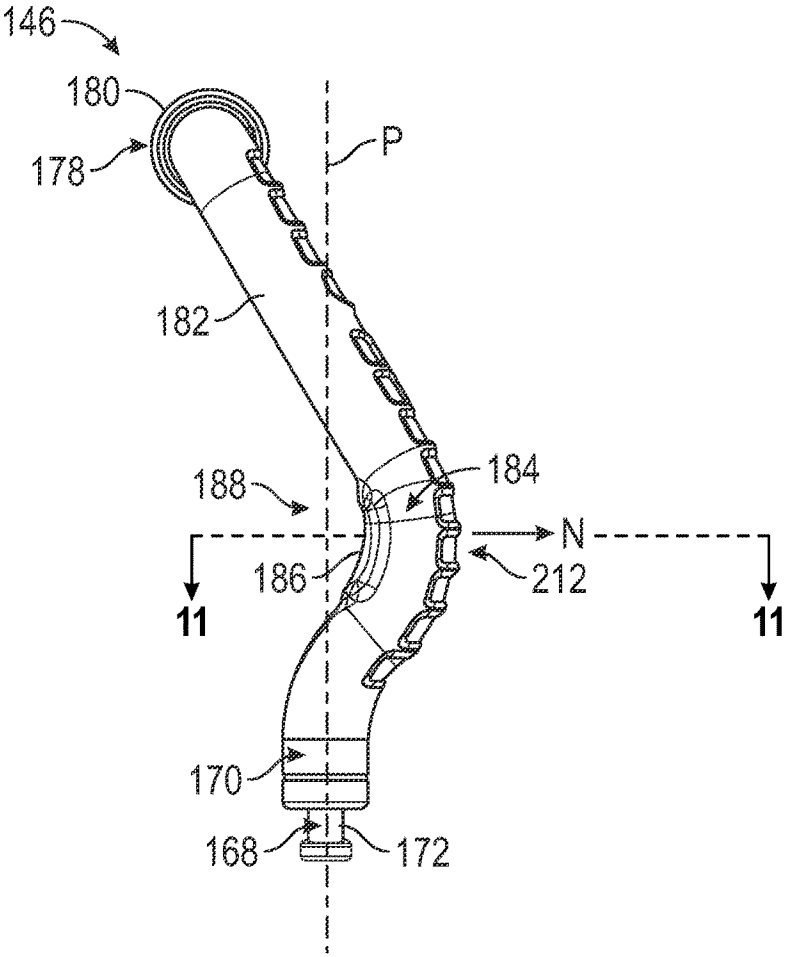
FIG. 10 is a right side view of the mounting bar of FIG. 7.

As shown in FIGS. 8, 10, and 11, the rounded notches 184 each include a pad 186 arranged on a concave side 188 of the rounded notch 184. In the illustrated embodiment, the pad 186 defines an area with an increased thickness of the sleeve 170 (e.g., a distance that the sleeve 170 extends outwardly from the core bar 168) relative to a thickness of the sleeve 170 along other areas of the leg portions 182. In general, the increased thickness defined by the sleeve 170 in the pads 186 provides wear protection in embodiments where one of the mounting bars 146 acts as a stop for the drawstring 138. For example, the concave side 188 of the rounded notch 184 formed in a front-most one of the mounting bars 146 (i.e., the first mounting bar 148) may act as a stop for the drawstring 138. That is, the drawstring 138 may engage the pads 186 of the first mounting bar 148 as the drawstring 138 moves to the undrawn position (see, e.g., FIG. 1) and prevent the drawstring from moving past the first mounting bar 148. The pads 186 can be or include an elastic or otherwise shock-absorbent material, such as rubber, plastic, resin, polymer, or some other material. For example, the pads 186 can include a sufficient amount of elastic material such that the pads 186 act to absorb an impact force imparted by the drawstring 138 on the first mounting bar 148 as the drawstring moves from the from the drawn position to the undrawn position as the crossbow is operated (i.e., fired). In some embodiments, the crossbow 100 includes a dedicated string stop that is separate from the mounting bars 146.

Figure 12:
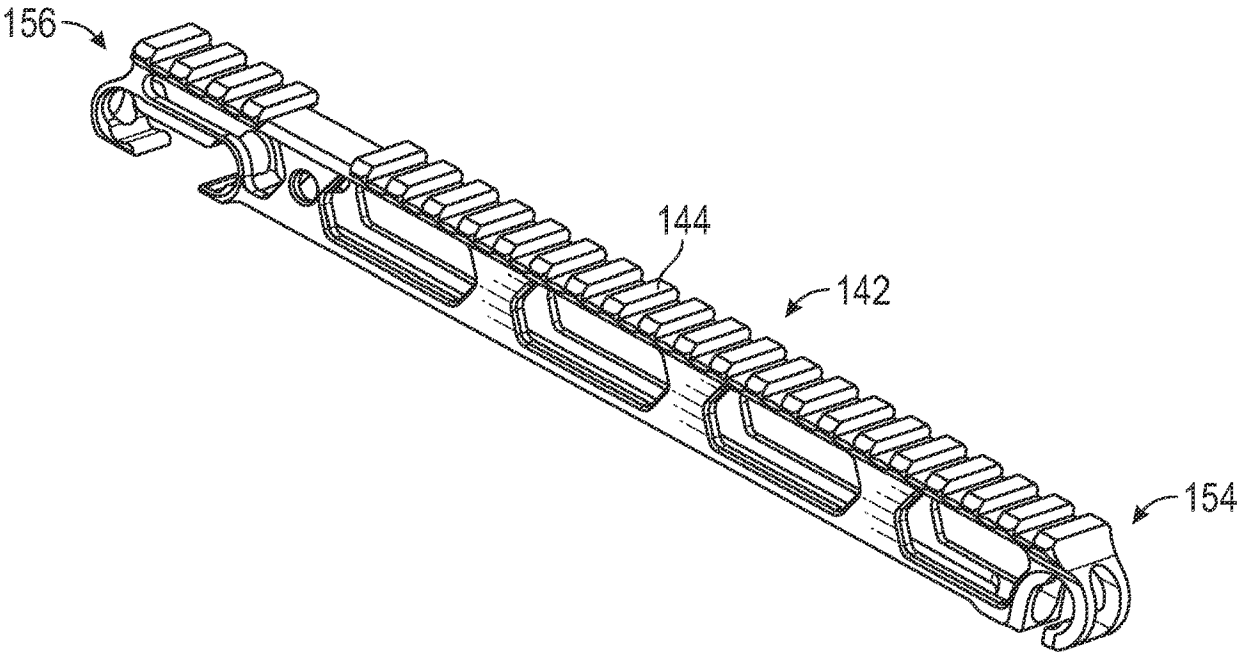
FIG. 12 is top, front, right perspective view of a mounting rail of the mounting rail assembly of FIG. 4.
Figure 13:
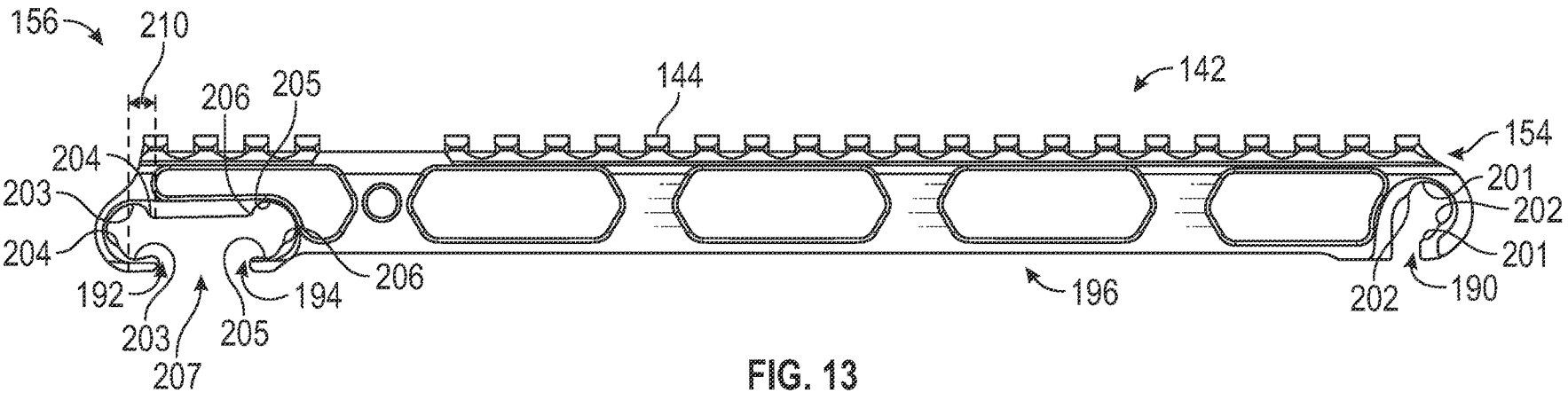
FIG. 13 is a right side view of the mounting rail of FIG. 12.

As shown in FIGS. 12 and 13, the mounting rail 142 includes at least two slot openings formed on axially opposite ends of the mounting rail 142. For example, the mounting rail 142 includes a first slot opening 190, a second slot opening 192, and a third slot opening 194. Each of the first slot opening 190, the second slot opening 192, and the third slot opening 194 is formed in a bottom side 196 of the mounting rail 142 and extends in a direction toward the mounting platform 144. The first slot opening 190 is arranged at the first axial end 154 of the mounting rail 142, the second slot opening 192 is arranged at a second axial end 156 of the mounting rail 142, and the third slot opening 194 is arranged axially between the first slot opening 190 and the second slot opening 192.

Figure 14:
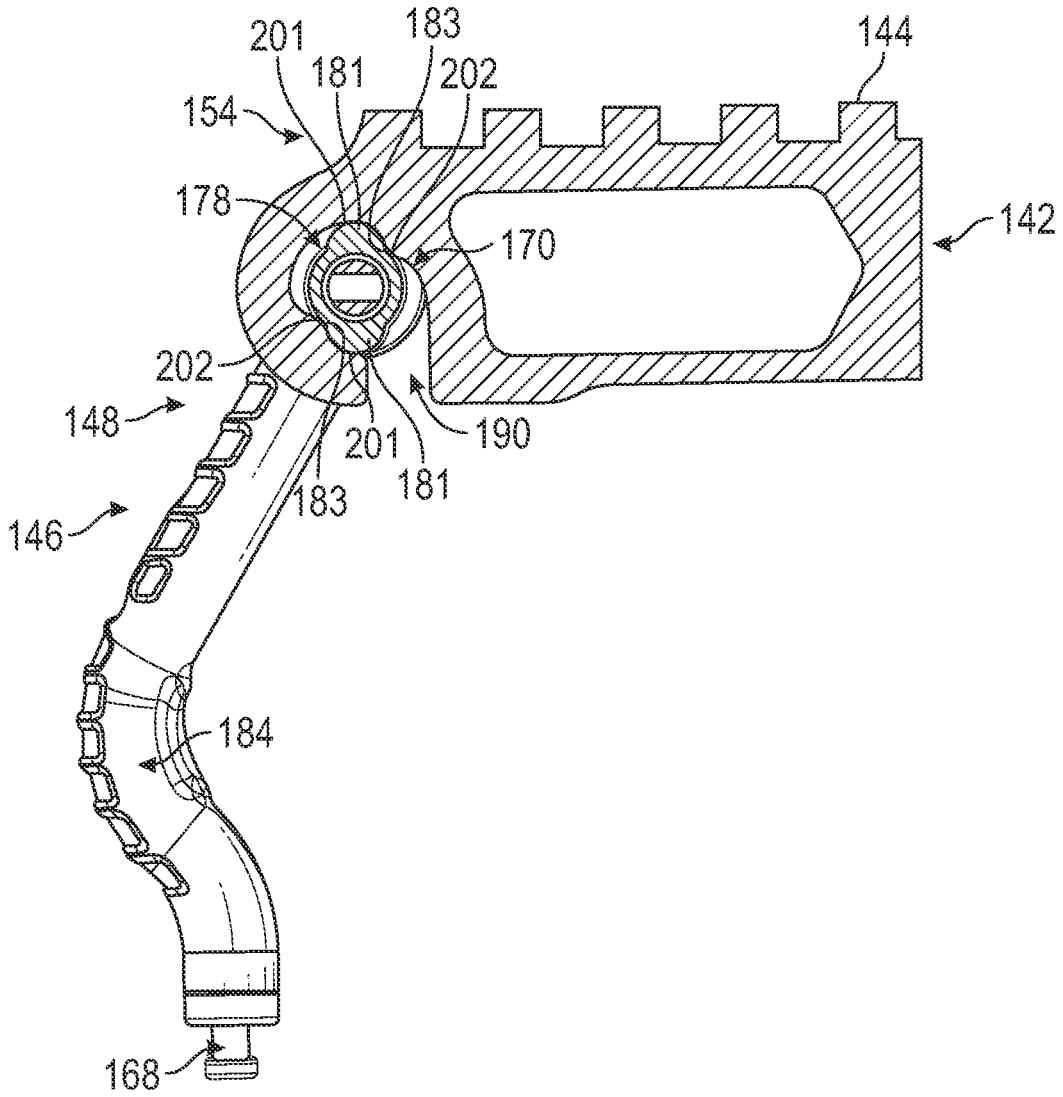
FIG. 14 is a cross-sectional view of the mounting rail inserted on the mounting bar of the mounting rail assembly of FIG. 4 taken along line 14-14 of FIG. 2.

Referring to FIGS. 13 and 14, the first slot opening 190, the second slot opening 192, and the third slot opening 194 are each configured to engage with the crossbar portion 178 to couple one or more mounting bars 146 with the mounting rail 142. The first slot opening 190 includes at least one first projection 202 (e.g., a ridge, a groove, a rib, a protrusion, a raised portion, or other projection.), which is shaped to engage with the crossbar portion 178 of the first mounting bar 148. Specifically, the projection 202 is configured to engage with the notch 183 of the crossbar portion 178 of the mounting bar 148. The first slot opening 190 further includes at least one recess 201 (e.g., an impression, a cut-out, a notch, a groove, a slot, or other recess). The recess 201 is recessed relative to a remainder of the first slot opening 190. The recess 201 is configured to engage with the crossbar portion 178. Specifically, the recess 201 is configured to engage with a protrusion of the crossbar portion 178. In some embodiments, the recess 201 and/or the projection 202 can be, include, or be formed from an elastic, semi-deformable, or semi-flexible material (e.g., plastic, resin, polymer, rubber, or some other material). In other examples, the recess 201 and/or the projection 202 can be or include a rigid material (e.g., metallic, composite, or some other material).

The second slot opening 192 includes at least one a second projection 204 that is shaped to engage with the crossbar portion 178 of the second mounting bar 150. Specifically, the projection 204 is configured to engage with the notch 183 of the crossbar portion 178 of the mounting bar 150. The second slot opening 192 further includes at least one recess 203 (e.g., an impression, a cut-out, a notch, a groove, a slot, or other recess). The recess 203 is recessed relative to a remainder of the second slot opening 192. The recess 203 is configured to engage with the crossbar portion 178 of the mounting bar 150. Specifically, the recess 203 is configured to engage with a protrusion 181 of the crossbar portion 178. In some embodiments, the recess 203 and/or the projection 204 can be, include, or be formed from an elastic, semi-deformable, or semi-flexible material (e.g., plastic, resin, polymer, rubber, or some other material). In other examples, the recess 203 and/or the projection 204 can be or include a rigid material (e.g., metallic, composite, or some other material).

The third slot opening 194 is defined by a third projection 206 that is shaped to receive the crossbar portion of the third mounting bar 152. Specifically, the projection 206 is configured to engage with the notch 183 of the crossbar portion 178 of the mounting bar 152. The third slot opening 194 further includes at least one recess 205 (e.g., an impression, a cut-out, a notch, a groove, a slot, or other recess). The recess 205 is recessed relative to a remainder of the third slot opening 194. The recess 205 is configured to engage with the crossbar portion 178 of the mounting bar 152. Specifically, the recess 205 is configured to engage with a protrusion 181 of the crossbar portion 178. In some embodiments, the recess 205 and/or the projection 206 can be, include, or be formed from an elastic, semi-deformable, or semi-flexible material (e.g., plastic, resin, polymer, rubber, or some other material). In other examples, the recess 205 and/or the projection 206 can be or include a rigid material (e.g., metallic, composite, or some other material).

Each of the first projection 202, the second projection 204, and the third projection 206 are shaped and sized to engage with a corresponding notch 183 of a respective mounting bar 146. For example, the first projection 202 can extend into the notch 183 of the first mounting bar 148 to prevent rotation or lateral movement of the crossbar portion 178 relative to the mounting bar 142. Likewise, the second projection 204 can extend into the notch 183 of the second mounting bar 150 to prevent rotation or lateral movement of the crossbar portion 178 relative to the mounting bar 142. Further, the third projection 206 can extend into the notch 183 of the third mounting bar 152 to prevent rotation or lateral movement of the crossbar portion 178 relative to the mounting bar 142. Each of the first recess 201, the second recess 203, and the third recess 205 are shaped and sized to engage with a corresponding protrusion 181 of a respective mounting bar 146. For example, the protrusion 181 of the crossbar portion 178 of the first mounting bar 148 can extend into the recess 201 to prevent rotation or lateral movement of the crossbar portion 178 relative to the mounting bar 142. Likewise, the protrusion 181 of the crossbar portion 178 of the second mounting bar 150 can extend into the recess 203 to prevent rotation or lateral movement of the crossbar portion 178 relative to the mounting bar 142. Further, the protrusion 181 of the crossbar portion 178 of the third mounting bar 152 can extend into the recess 205 to prevent rotation or lateral movement of the crossbar portion 178 relative to the mounting bar 142.

The engagement of the mounting bar 146 (e.g., the first mounting bar 148, the second mounting bar 150 and/or the third mounting bar 152) with the mounting rail 142 (e.g., the slot opening 190, the second slot opening 192, and/or the third slot opening 194) can secure the mounting rail 142 to the crossbow 100. Specifically, the respective engagement of the protrusion(s) 181 and notch(es) 183 of the mounting bar 146 with the recesses (e.g., recess 201, recess 203, recess 205) and projections (e.g., projection 202, projection 204, and projection 206) of the mounting rail 142 is configured to substantially prevent or reduce at least one or more of side-to-side (e.g., horizontal) movement, up-and down (e.g., vertical) movement, back-and forth (e.g. longitudinal) movement, or other shifting movement of the mounting rail 142 relative to the mounting bar 146 and/or barrel rail 104.

In some embodiments, at least one of the slot openings formed in the mounting rail 142 may define a shared opening, shown an insert opening 207, with another slot opening. For example, the second slot opening 192 shares the insert opening 207 with the third slot opening 194 such that when the second mounting bar 150 is received within or removed from the second slot opening 192 or the third mounting bar 152 is received within or removed from the third slot opening 194, the second mounting bar 150 and the third mounting bar 152 pass through the insert opening 207. In some embodiments, the mounting rail 142 includes a fourth slot opening arranged axially between the first slot opening 190 and the third slot opening 194. The fourth slot opening may share an insert opening, similar to insert opening 207, with the first slot opening 190.

In some embodiments, at least one of the slot openings formed in the mounting rail 142 may define a generally curved profile. For example, the first slot opening 190 may define a curvature that curves in a direction toward the first axial end 154 or the second axial end 156. The second slot opening 192 may define a curvature that curves in a direction toward the first axial end 154 or the second axial end 156. The third slot opening 194 may defines a curvature that curves in a direction toward the first axial end 154 or the second axial end 156. In some alternative embodiments, the mounting rail 142 includes a fourth slot opening arranged axially between the first slot opening 190 and the third slot opening 194. The fourth slot opening may define a curvature that curves in a direction toward the first axial end 154 or the second axial end 156.

The first slot opening 190, the second slot opening 192, and the third slot opening 194 are configured to couple to the crossbar portion 178 of the first mounting bar 148, the second mounting bar 150, and the third mounting bar 152, respectively. FIG. 14 shows an exemplary coupling between the first mounting bar 148 and the first slot opening 190. The following description also applies to the coupling between the second mounting bar 150 and the second slot opening 192 and between the third mounting bar 152 and the third slot opening 194. As shown in FIG. 14, the crossbar portion 178 is configured to be received within the first slot opening 190 to form the coupling between the first mounting bar 148 and the mounting rail 142. In some embodiments, a press fit or an interference fit is formed between the crossbar portion 178 and the first slot opening 190. For example, an external size or diameter 208 defined by the crossbar portions 178 (see, e.g., FIG. 9) is greater than or equal to a size 210 defined by the first slot opening 190 (see, e.g., FIG. 13), so that when the first slot opening 190 of the mounting rail 142 is inserted onto the crossbar portion 178, an interference (e.g., engagement) between the crossbar portion 178 and the first slot opening 190 secures the mounting rail 142 to the first mounting bar 148. In some embodiments, the elastic material of the sleeve 170 is configured to allow the crossbar portion 178 to at least partially deform (e.g., compress) as the first slot opening 190 is inserted onto the crossbar portion 178, which ensures a strong interference or press fit between the first mounting bar 148 and the mounting rail 142. The elastic material of the sleeve 170 also reduces rattling or vibrations along the mounting rail 142 during operation of the crossbow 100.

In general, utilizing an interference or press fit between the mounting rail 142 and the mounting bars 146 reduces the number of components required to install the mounting rail assembly 140 on the crossbow 100 by eliminating a need for additional fasteners coupled between the mounting rail 142 and the mounting bars 146. An example installation of the mounting rail assembly 140 on the barrel rail 104 of the crossbow 100 will be described with reference to FIGS. 4-14. In some embodiments, the mounting bars 146 are initially installed onto the barrel rail 104. For example, the first mounting post 172 and the second mounting post 174 of each of the first mounting bar 148, the second mounting bar 150, and the third mounting bar 152 may be inserted into the mounting apertures 164 of a respective one of the first group of mounting apertures 158, the second group of mounting apertures 160, and the third group of mounting apertures 162. In the illustrated embodiment, the first mounting post 172 and the second mounting post 174 of the first mounting bar 148 are inserted into the mounting apertures 164 of the first group of mounting apertures 158, the first mounting post 172 and the second mounting post 174 of the second mounting bar 150 are inserted into the mounting apertures 164 of the second group of mounting apertures 160, and the first mounting post 172 and the second mounting post 174 of the third mounting bar 152 are inserted into the mounting apertures 164 of the third group of mounting apertures 162.

In some embodiments, at least two of the mounting bars 146 may be installed on the barrel rail 104 in different orientations. A mounting orientation of one of the mounting bars 146 may be defined by a direction of a normal N extending outwardly from a convex side 212 of the rounded notch 184 (see, e.g., FIG. 10). For example, as shown in FIG. 4, the first mounting bar 148 is mounted in a forward-facing orientation with the convex side 212 facing toward the front end 114, and the second mounting bar 150 is mounted in a rearward-facing orientation with the convex side 212 facing the rear end 112. In the illustrated embodiment, the third mounting bar 152 is mounted in the forward-facing orientation. In some embodiments, the mounting rail assembly 140 includes a fourth mounting bar arranged axially between the first mounting bar 148 and the third mounting bar 152 arranged in the rearward-facing orientation. In alternative embodiments, the mounting rail assembly includes a fourth mounting bar arranged axially between the first mounting bar 148 and the third mounting bar 152 arranged in the forward-facing orientation.

With the first mounting post 172 and the second mounting post 174 inserted into the respective mounting apertures 164 and the mounting bars 146 arranged in their particular orientations, a set screw 214 (as shown in FIGS. 4-6) may be threaded into each of the set screw apertures 166 to engage a respective one of the first mounting post 172 and the second mounting posts 174 and secure each of the first mounting bar 148, the second mounting bar 150, and the third mounting bar 152 to the barrel rail 104. After the mounting bars 146 are secured to the barrel rail 104, the mounting rail 142 may be inserted onto the mounting bars 146. For example, the mounting rail 142 may be inserted onto each of the first mounting bar 148, the second mounting bar 150, and the third mounting bar 152 so that the first slot opening 190, the second slot opening 192, and the third slot opening 194 are axially and laterally aligned with the crossbar portion 178 of the first mounting bar 148, the second mounting bar 150, and the third mounting bar 152, respectively. In some embodiments, the mounting flanges 180 aid in laterally aligning the mounting rail 142 relative to the crossbar portion 178. For example, the increased size or diameter defined by the mounting flanges 180 relative to the crossbar portion 178 enables the mounting flanges 180 to act as a lateral guide or barrier that acts to maintain the mounting rail 142 laterally between the mounting flanges 180. The mounting rail 142 may be pressed or forced onto the mounting bars 146 so that the crossbar portion 178 slide into the first slot opening 190, the second slot opening 192, and the third slot opening 194, respectively, and form an interference or press fit therebetween. The interference or press fit formed between the crossbar portion 178 and the first slot opening 190, the second slot opening 192, and the third slot opening 194, respectively, securely couples the mounting rail 142 to each of the mounting bars 146 and, thereby, to the barrel rail 104.

In some embodiments, the set screw 214 may be removed from each of the set screw apertures 166 to enable the mounting bars 146 and the mounting rail 142 to be selectively removed from the barrel rail 104. In some embodiments, the mounting rail 142 is first coupled to the mounting bars 146 and then the assembly of the mounting rail 142 and the mounting bars 146 is installed on the barrel rail 104 and secured using the set screws 214. Regardless of the particular order of the installation steps, with the mounting rail 142 installed on the barrel rail 104, the mounting bars 146 elevate the mounting rail 142 above the upper surface 120 so that a gap or clearance is provided between the flight groove 122 and the bottom side 196 of the mounting rail 142. The gap between the flight groove 122 and the bottom side 196 of the mounting rail 142 provides space for an arrow to be placed within and fired from the flight groove 122. In some embodiments, the string clearance 176 defined between the first mounting post 172 and the second mounting post 174 ensures that the mounting bars 146 (e.g., the second mounting bar 150 and the third mounting bar 152) do not interfere (e.g., engage) the drawstring 138 as it is moved to the drawn position. Thus, the design and properties of the mounting bars 146 orient the mounting rail 142 in a location that both aligns with a user's line of sight for optimal placement of accessories (e.g., sights, scopes, optics etc.) and does not interfere with the firing operation of the drawstring 138. In addition, the mounting bars 146 provide support for the mounting rail 142 at both the first axial end 154 and the second axial end 156 to reduce or eliminate movement/flexing of the mounting rail 142, when compared to conventional cantilevered mounting rails that are only supported at one end.

In some embodiments, the mounting rail assembly 140, including the mounting rail 142, the mounting bars 146, and the set screws 214, may form a mounting rail kit that is provided to enable selective installation of the mounting rail 142 on a crossbow (e.g., the crossbow 100).

As utilized herein with respect to numerical ranges, the terms "approximately," "about," "substantially," and similar terms generally mean +/−10% of the disclosed values. When the terms "approximately," "about," "substantially," and similar terms are applied to a structural feature (e.g., to describe its shape, size, orientation, direction, etc.), these terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using one or more separate intervening members, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps or operations, the order of such steps may differ from what is depicted and described, unless specified differently above. Also, two or more steps may be performed concurrently or with partial concurrence, unless specified differently above.

It is important to note that the construction and arrangement of the crossbow 100 and the mounting rail assembly 140 as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A crossbow, comprising:
- a stock;
- a riser;
- a barrel rail coupled to the stock and the riser and defining a projectile axis;
- a limb assembly coupled to the riser; and
- a mounting rail assembly including:
  - a mounting rail defining a first axial end and a second axial end;
  - a first mounting bar coupled to the barrel rail and the first axial end of the mounting rail; and
  - a second mounting bar coupled to the barrel rail and the second axial end of the mounting rail.

2. The crossbow of claim 1, wherein each of the first mounting bar and the second mounting bar includes a pair of leg portions and a crossbar portion that extends laterally between the pair of leg portions.

3. The crossbow of claim 2, wherein the mounting rail includes a first slot opening arranged adjacent to the first axial end and a second slot opening arranged adjacent to the second axial end.

4. The crossbow of claim 3, wherein the crossbar portion of the first mounting bar is received within the first slot opening and the crossbar portion of the second mounting bar is received within the second slot opening.

5. The crossbow of claim 4, wherein an engagement of the crossbar portion of the first mounting bar with the first slot opening defines an interference or press fit that couples the first mounting bar to the mounting rail, and wherein an engagement of the crossbar portion of the second mounting bar with the second slot opening defines an interference or press fit that couples the second mounting bar to the mounting rail.

6. The crossbow of claim 1, wherein each of the first mounting bar and the second mounting bar includes a notch.

7. The crossbow of claim 6, wherein the first mounting bar is arranged with the notch in a forward-facing orientation, and the second mounting bar is arranged with the notch in a rearward-facing orientation.

8. The crossbow of claim 6, further comprising a drawstring, wherein the notch of the first mounting bar is configured to engage the drawstring in an undrawn position and act as a stop for the drawstring.

9. The crossbow of claim 1, further comprising a third mounting bar spaced from the second mounting bar and coupled to the barrel rail and the mounting rail at a position between the first axial end and the second axial end of the mounting rail.

10. A mounting rail assembly for a crossbow, comprising:

a mounting rail including a first axial end and a second axial end;

a first mounting bar detachably coupled to the first axial end of the mounting rail, the first mounting bar including a first pair of leg portions having at least one notch arranged in a forward-facing orientation, the first pair of leg portions extending from the mounting rail; and a second mounting bar detachably coupled to the second axial end of the mounting rail, the second mounting bar including a second pair of leg portions having at least one notch arranged in a rearward-facing orientation, the second pair of leg portions extending from the mounting rail.

11. The mounting rail assembly of claim 10, wherein the first mounting bar includes a first crossbar portion that extends laterally between the first pair of leg portions, and wherein the second mounting bar includes a second crossbar portion that extends laterally between the second pair of leg portions.

12. The mounting rail assembly of claim 11, wherein the mounting rail includes a first slot opening arranged proximate to the first axial end and a second slot opening arranged proximate to the second axial end, wherein the first crossbar portion of the first mounting bar is detachably received within the first slot opening and the second crossbar portion of the second mounting bar is detachably received within the second slot opening.

13. The mounting rail assembly of claim 12, wherein an engagement of the first crossbar portion of the first mounting bar with the first slot opening defines an interference or press fit that couples the first mounting bar to the mounting rail, and wherein an engagement of the second crossbar portion of the second mounting bar with the second slot opening defines an interference or press fit that couples the second mounting bar to the mounting rail.

14. The mounting rail assembly of claim 10, wherein the at least one notch includes a pad having an elastic material.

15. A crossbow, comprising:

a stock;

a riser;

a barrel rail coupled between the stock and the riser and defining a projectile axis;

a first cam and a second cam;

a drawstring engaged with the first cam and the second cam, the drawstring extending across the projectile axis and configured to move from an undrawn position and a drawn position during operation of the crossbow; and a mounting rail assembly including:

a mounting rail defining a first axial end and a second axial end;

a first mounting bar coupled to the barrel rail and the first axial end of the mounting rail; and a second mounting bar coupled to the barrel rail and the second axial end of the mounting rail, wherein the drawstring extends across the projectile axis at an axial position between the first mounting bar and the second mounting bar.

16. The crossbow of claim 15, wherein the barrel rail includes a flight groove extending along the projectile axis, and wherein the first mounting bar and the second mounting bar position the mounting rail above the flight groove to define a gap between the flight groove and a bottom side of the mounting rail.

17. The crossbow of claim 15, wherein each of the first mounting bar and the second mounting bar includes a first mounting post and a second mounting post laterally separated from the first mounting post.

18. The crossbow of claim 17, wherein the first mounting post is received in a first mounting aperture of the barrel rail and the second mounting post is received in a second mounting aperture of the barrel rail.

19. The crossbow of claim 18, the barrel rail defining a first set screw aperture and a second set screw aperture, the first set screw aperture at least partially intersecting the first mounting aperture, the second set screw aperture at least partially intersecting the second mounting aperture, wherein the first mounting post is secured in the first mounting aperture via a first set screw received in the first set screw aperture, and wherein the second mounting post is secured in the second mounting aperture via a second set screw received in the second set screw aperture.

20. The crossbow of claim 19, wherein, during operation of the crossbow, the drawstring is configured to contact the first mounting bar as the drawstring moves from the drawn position to the undrawn position.

* * * * *